US005108635A

United States Patent [19]

Gabillet et al.

[11] Patent Number: 5,108,635

[45] Date of Patent: Apr. 28, 1992

[54] VISCOSITY ADDITIVE FOR LUBRICATING OILS, PROCESS FOR ITS PREPARATION AND LUBRICATING COMPOSITIONS BASED ON THE SAID ADDITIVE

[75] Inventors: Philippe Gabillet; Claudie Willemin, both of Paris; Bernard Chauvel, Ermont, all of France

[73] Assignee: Societe Francaise d'Organo Synthese, Courbevoie, France

[21] Appl. No.: 470,599

[22] Filed: Jan. 26, 1990

[30] Foreign Application Priority Data

Jan. 27, 1989 [FR] France ..... 89 00992

[51] Int. Cl.[5] ..... C10M 157/10; C10M 157/04

[52] U.S. Cl. ..... 252/56 R; 252/51.5 A

[58] Field of Search ..... 252/56 R

[56] References Cited

U.S. PATENT DOCUMENTS

| | | | |
|---|---|---|---|
| 3,506,574 | 4/1970 | Stambaugh et al. | 252/51.5 A |
| 3,607,749 | 9/1971 | Forbes | 252/56 R |
| 3,697,429 | 10/1972 | Engel et al. | 252/59 |
| 3,897,353 | 7/1975 | Morduchowitz et al. | 252/56 R |
| 3,923,930 | 12/1975 | Waldbillig | 260/878 R |
| 4,031,020 | 6/1977 | Sugiura et al. | 252/56 R |
| 4,149,984 | 4/1979 | Wenzel et al. | 252/56 R |
| 4,229,311 | 10/1980 | Wenzel et al. | 252/50 |
| 4,290,925 | 9/1981 | Pennewiss et al. | 252/56 R |
| 4,758,364 | 7/1988 | Seki et al. | 252/56 R |
| 4,776,967 | 10/1988 | Ichihashi et al. | 252/56 R |
| 4,844,829 | 7/1989 | Wilburn et al. | 252/56 R |
| 4,956,111 | 9/1990 | Wilburn et al. | 252/56 R |

FOREIGN PATENT DOCUMENTS

| | | | |
|---|---|---|---|
| 193272 | 9/1986 | European Pat. Off. . | |
| 0280260 | 8/1988 | European Pat. Off. . | |
| 2905954 | 8/1980 | Fed. Rep. of Germany | 252/56 R |
| 7317671 | 12/1972 | Netherlands | 252/56 R |
| 1525402 | 9/1978 | United Kingdom . | |

OTHER PUBLICATIONS

Search Report (Institut National de la Propriete Industrielle) for French Application No. 89 00992.

*Primary Examiner*—Prince Willis, Jr.
*Assistant Examiner*—E. McAvoy
*Attorney, Agent, or Firm*—Finnegan, Henderson, Farabow, Garrett and Dunner

[57] ABSTRACT

A composition of matter, particularly useful as a viscosity additive comprising:

6 to 15 parts by weight of a 60/40-54/46 ethylene/propylene copolymer of Mw 155,000-250,000 (OCP), 2 to 8 parts by weight of a poly($C_1$-$C_{20}$ alkyl methacrylate) of Mw 30,000-150,000 (PMA) with a PMA-/OCP ratio of 1/5 to 1/1, and the complement to 100 parts by weight of diluent oil.

Also disclosed are lubricating compositions comprising the above additive composition, preferably in an amount of from 0.1 to 10% by weight based on the weight of lubricating oil.

19 Claims, No Drawings

VISCOSITY ADDITIVE FOR LUBRICATING OILS, PROCESS FOR ITS PREPARATION AND LUBRICATING COMPOSITIONS BASED ON THE SAID ADDITIVE

FIELD OF THE INVENTION

The present invention relates to a composition of matter, particularly useful as a viscosity additive for lubricating oils, based on a polyalkyl methacrylate and on an olefin copolymer, to the process for the preparation of the additive, and to lubricating compositions containing the additive.

BACKGROUND OF THE INVENTION

Polymethacrylates (PMA) and olefin copolymers (OCP) are two classes of viscosity additives.

Each of these two classes has advantages and disadvantages which are specific to it. The PMAs make it possible to obtain low-temperature rheological properties which are superior to those of the OCPs; in addition, they affect the pour point of the lubricating bases On the other hand, their thickening effect is inferior to that of the OCPs; because of this, they must be employed in higher concentrations when lubricating formulations are produced Investigations have therefore been made to combine these two additives into a single one in order to unite the advantages of each of these polymers in a simple manner.

Attempts have been made to produce an additive of this kind, the simplest method consisting in mixing the two polymers, starting with commercially available additives. However, as is indicated by U.S. Pat. No. 4,290,925 and BE Patent No. 870,329 (the latter corresponding to U.S. Pat. Nos. 4,149,984 and 4,229,311), such mixtures are stable over time only when one of the polymers represents less than 5% of the total weight of the polymers This is why more complex methods have been envisaged, such as the grafting of a PMA onto an OCP backbone (BE Patent No. 870,329, U.S. Pat. No. 4,229,311 and U.S. Pat. No. 3,923,930). A more complex technique consists in grafting an OCP with PMA and then employing this copolymer as a compatibilizer to stabilize emulsion mixtures of OCP and of PMA (European Patent No. 193,272 and U.S. Pat. No. 4,290,925).

SUMMARY OF THE INVENTION

The instant invention is directed to a composition of matter, particularly useful as a viscosity additive, which is especially economical and stable over time, even though it comprises at the same time high proportions of, on the one hand, PMA and, on the other hand, OCP.

DETAILED DESCRIPTION OF THE INVENTION

The composition of matter of the instant invention, particularly useful as a viscosity additive, is based on an olefin copolymer and a polyalkyl methacrylate in solution in diluent oil, which composition comprises:

from 6 to 15 parts by weight, preferably from 7.5 to 12.5 parts by weight, of at least one ethylene-propylene copolymer having a weight-average molecular mass ranging from approximately 155,000 to approximately 250,000, preferably from 155,000 to 230,000, most preferably from 155,000 to 190,000, and exhibiting an ethylene/propylene weight ratio ranging from 60/40 to 54/46, preferably from 58/42 to 54/46, from 2 to 8 parts by weight, preferably from 2.5 to 7.5 parts by weight, of at least one poly($C_1$–$C_{20}$ alkyl methacrylate), ungrafted or grafted with 1 to 8% of its weight, preferably from 1 to 4% of its weight, of a dispersant monomer, the polymethacrylate having a weight-average molecular mass ranging from 30,000 to 150,000, preferably from 60,000 to 120,000, it being possible for the ungrafted or grafted polymethacrylate/ethylene-propylene copolymer weight ratio to range from 1/5 to 1/1, and the complement to 100 parts by weight of diluent oil.

In a further embodiment of the additive composition forming the subject of the invention, the additive composition additionally contains from 0 to 10% of its weight, preferably from 0.1 to 0.4% of its weight, of an antioxidant agent.

Preferably, both the olefinic and methacrylic polymers forming the additive composition have a polydispersity index which is as low as possible; an index which is lower than 3.5 is particularly favorable The polyalkyl methacrylate employed is preferably a mixture consisting of from 0 to 10% by weight of light polymethacrylates in which the alkyl group is lower than $C_4$ and of from 10 to 100% by weight of heavy polymethacrylates in which the alkyl group ranges from $C_{10}$ to $C_{20}$, preferably from $C_{10}$ to $C_{18}$.

Among the optional dispersant monomers, that is to say monomers which provide the additive units with a dispersant action on the sludge in the lubricating oil, there may be mentioned nitrogenous vinyl monomers, especially nitrogenous vinyl monomers such as N-vinylpyrrolidone, N-vinylimidazole and N-vinylpyridine.

The diluent oil employed may be any base oil, such as a petroleum oil of paraffinic tendency, a mineral oil, a synthetic oil of the alkylene polymer type, diacid esters or polyol esters The diluent oil employed may be selected from those commercially available.

Exemplary antioxidant agents which are optionally employed include: dialkylamines in which the alkyl group is higher than $C_{12}$, optionally sulfurized alkyldiphenylamines and optionally sulfurized alkylphenols.

The viscosity additive composition forming the subject of the invention may be prepared by mixing, in the proportions indicated above, a solution of an ethylene-propylene copolymer such as defined above in the diluent oil and a solution of ungrafted or grafted polymethacrylate such as defined above in a similar or different diluent oil.

The solutions of olefinic and methacrylic polymers may be commercial or noncommercial solutions.

Polymers of molecular masses higher than those set forth above may be used; a preliminary shearing is then performed, thus making it possible to arrive at polymers of the desired molecular mass.

When an antioxidant agent is present in the additive composition, the latter is preferably premixed with the olefinic copolymer solution.

The present invention also includes lubricating compositions obtained by adding to at least one lubricating oil, especially at least one oil selected from motor oils and oils for casings and axles, the additive composition described above, preferably in an amount of from 0.1 to 10% by weight, most preferably from 1 to 5% by weight, relative to the lubricating oil.

These compositions may also contain other conventional additives such as dispersants, detergents, corrosion inhibitors and extreme pressure additives The following examples are given by way of guidance, and must not be considered as limiting either the field or the spirit of the invention.

EXAMPLE 1

The following were introduced in succession into a 250-$cm^3$ beaker:

75 g of a solution at a concentration of 10% by weight in a 150 N oil (predominantly paraffinic oil with a kinematic viscosity of between 28 and 32.5 $mm^2/s$ at 40° C.) of an ethylene-propylene copolymer ("OCP") exhibiting an ethylene units/propylene units weight ratio of 58/42, a weight molecular mass of 230,000 and a polydispersity index of 3.1, 4.3 g of a solution containing 58% by weight in a 150 N oil of a copolyalkyl methacrylate ("PMA") (in which the average length of the alkyl chains is 10 carbon atoms) grafted with 3.5% by weight of N-vinylpyrrolidone (% by weight relative to the combined copolymethacrylate) exhibiting a weight molecular mass of 114,000 and a polydispersity index of 2.5, and 20.7 g of 150 N oil.

This mixture was stirred for one hour at 100° C. After cooling, a mixture was obtained which was still stable after 300 days.

(The determination of stability is carried out by visual observation. Mixtures in which a strong opalescence, an emulsion of the oil-in-oil type or a demixing are observed are considered to be unstable )

The following characteristics of the product appear in Table I:

thickening power (TP): quantity of active material (a.m.), that is to say of dry mixture of polymers, needed to obtain a kinematic viscosity of 13.8 $mm^2/s$ at 100° C. (measured according to ASTM standard D 445) in a 200 N oil (paraffinic oil whose kinematic viscosity at 40° C. is 37.5–43.5 $mm^2/s$), viscosity index (VIE): measured according to ASTM standard D 2270 with the aid of 5% by weight of the above mixture in a 200 N oil, cold starting simulator (C.C.S. "cold cranking simulator"): according to ASTM standard D 2602 at −15° C.

EXAMPLE 2

A mixture consisting of the following was prepared according to the operating procedure of Example 1:

87.5 g of the OCP solution described in Example 1, 6.5 g of the PMA solution described in Example 1, and 6 g of 150 N oil.

The properties of the mixture are shown in Table I.

EXAMPLE 3

A mixture consisting of the following was prepared according to the operating procedure of Example 1:

76.5 g of a solution at a concentration of 9.8% by weight in a 150 N oil of an OCP exhibiting an ethylene/propylene weight ratio of 58/42, a weight molecular mass of 177,400 and a polydispersity index of 2.3, 0.2 g of phenolic antioxidant (Garbanox 150 marketed by the Societe Francaise d'Organo Synthese), 4.3 g of the PMA solution described in Example 1, and 19.2 g of 150 N oil.

The properties of the mixture are shown in Table I.

EXAMPLE 4

A mixture consisting of the following was prepared according to the operating procedure of Example 1:

89.3 g of the OCP solution described in Example 3, 0.2 g of the antioxidant of Example 3, 6.5 g of the PMA solution described in Example 1, and 4.2 g of 150 N oil.

The properties of the mixture are shown in Table I.

The properties of the mixtures obtained in Examples 1 to 4 were compared with the following mixtures:

test A: the PMA described in Example 1, tests B, C: OCP (ethylene/propylene): ECA 6710 and ECA 8586, marketed by Paramins, tests D, E, F: OCPs grafted with PMA: Viscoplex 5164C, Viscoplex 5067, Viscoplex 5962 marketed by Rohm.

The results which appear in Table I show that the mixtures of Examples 1 to 4 exhibit a thickening power equivalent to that of the OCPs and clearly superior to that of the PMA-grafted OCPs a VIE superior or equal to that of the OCPs a low-temperature behavior superior or equal to that of the OCPs, PMAs and PMA-grafted OCPs (see Example 3).

The concentration of active material (polymer) in the mixtures of the invention is on the same order or lower than those of the commercial OCPs.

EXAMPLE 5

A mixture consisting of the following was prepared according to the operating procedure of Example 1:

10 g of the OCP described in Example 1, taken in the pure state (and not in solution in a 150 N oil), 12.9 g of the PMA solution described in Example 1, and 77.1 g of 150 N oil.

EXAMPLE 6

A mixture consisting of the following was prepared according to the operating procedure of Example 1:

75.6 g of the OCP solution described in Example 1, 4.6 g of a solution at a concentration of 54% by weight in a 150 N oil of an ungrafted copolyalkyl methacrylate exhibiting an average alkyl chain length of 10 carbon atoms, a weight molecular mass of 114,000 and a polydispersity index of 2.5, and 20.4 g of 150 N oil.

EXAMPLE 7

A mixture consisting of the following was prepared according to the operating procedure of Example 1:

89.3 g of the OCP solution described in Example 3, 0.2 g of the antioxidant described in Example 3, 10.4 g of a solution at a concentration of 36% in 150 N oil of a copolyalkyl methacrylate (average alkyl chain length: 10 C) grafted with 1% of N-vinylimidazole, exhibiting a weight molecular mass of 114,000 and a polydispersity index of 2.5, and 0.3 g of 150 N oil.

EXAMPLE 8

A mixture consisting of the following was prepared according to the operating procedure of Example 1:

76.5 g of the OCP solution described in Example 3, 0.2 g of the antioxidant described in Example 3, and 4.3 g of a solution at a concentration of 58% in 150 N oil of a copolyalkyl methacrylate (average alkyl chain length: 10 C) grafted with 3.5% by weight of N-vinylpyrrolidone, exhibiting a weight molecular mass of 63,700 and a polydispersity index of 2.9.

EXAMPLE 9

A mixture consisting of the following was prepared according to the operating procedure of Example 1:

89.3 g of the OCP solution described in Example 4,
0.2 g of the antioxidant described in Example 4, and
6.5 g of the PMA solution of Example 8.

EXAMPLE 10

A mixture consisting of the following was prepared according to the operating procedure of Example 1:

12.5 g of the OCP described in Example 1, taken in the pure state,
4.3 g of the PMA solution of Example 1, and
83.2 g of 150 N oil.

EXAMPLE 11

A mixture consisting of the following was prepared according to the operating procedure of Example 1:

75 g of the OCP solution described in Example 1,
12.9 g of the PMA solution of Example 3, and
12.1 g of 150 N oil.

The stability of the mixtures of Examples 1 to 11 is shown in Table II.

EXAMPLE 12, COMPARATIVE

A mixture consisting of the following was prepared according to the operating procedure of Example 1:

37.5 g of the OCP solution described in Example 1,
8.6 g of the PMA solution of Example 1, and
53.9 g of 150 N oil.

It was found that the mixture demixed at the end of 6 days.

EXAMPLE 13, COMPARATIVE

A mixture consisting of the following was prepared according to the operating procedure of Example 1:

75 g of the OCP solution described in Example 3,
0.2 g of the antioxidant of Example 3,
2.2 g of the PMA solution of Example 3, and
22.8 g of 150 N oil.

It was found that the mixture salted out after 90 days.

Lubricating Formulations

Four lubricating formulations of 15 W 40 grade were prepared by introducing into a beaker:

respectively:

14.3 parts by weight of the mixture from Example 3
10 parts by weight of the mixture from Example 4
10.3 parts by weight of ECA 8685
5.9 parts by weight of Viscoplex 5164C, 5 parts by weight of multifunctional package OLOA 4261 D marketed by Orogil, and the complement to 100 parts by weight of a mixture of paraffinic base oils containing 80% by weight of 175 N grade oil and 20% of 600 N grade oil.

Stirring was carried out for 1 hour at 80° C.

The following were determined for these four formulations:

their kinematic viscosity at 100° C. and at 40° C. according to ASTM standard D 445 their VIE according to ASTM standard D 2270 their CCS at −15° C. according to ASTM standard 2602.

The results appear in Table III.

TABLE I

| Example or Test | TP % a.m. | VIE | CCS | % Active Material |
|---|---|---|---|---|
| A | 4.9 | 147 | 2450 | 58 |
| B | 1.51 | 123 | 2200 | 11 |
| C | 2.14 | 121 | 2100 | 17 |
| D | 2.68 | 136 | 2500 | 40 |
| E | 3.6 | 142 | 2100 | 60 |
| F | 2.04 | 137 | 2300 | 34 |
| 1 | 1.07 | 126 | — | 10 |
| 2 | 1.06 | 132 | — | 12.5 |
| 3 | 1.36 | 123 | 1500 | 10 |
| 4 | 1.45 | 125 | 2500 | 12.5 |

TABLE II

| EXAMPLE | STABILITY (days) |
|---|---|
| 1 | >300 |
| 2 | >300 |
| 3 | >300 |
| 4 | >300 |
| 5 | >150 |
| 6 | >150 |
| 7 | >150 |
| 8 | >150 |
| 9 | >150 |
| 10 | >150 |
| 11 | >150 |
| 12 | 6 |
| 13 | 90 |

TABLE III

| ADDITIVE | % | a.m. % | V 100° C. $mm^2/s$ | V 40° C. $mm^2s$ | VIE | CCS |
|---|---|---|---|---|---|---|
| ECA 8586 | 10.3 | 1.75 | 13.99 | 105.05 | 135 | 3300 |
| Viscoplex 5164 c | 5.9 | 3.36 | 14.32 | 102.19 | 144 | 3200 |
| mixture from Example 3 | 14.3 | 1.43 | 14.51 | 104.9 | 142 | 3300 |
| mixture from Example 4 | 10.0 | 1.25 | 14.18 | 103.7 | 139 | 3100 |

What is claimed is:

1. A composition of matter based on an olefin copolymer and on a polyalkyl methacrylate in solution in diluent oil, said composition comprising from 6 to 15 parts by weight of at least one ethylene-propylene copolymer of weight-average molecular mass ranging from approximately 155,000 to approximately 250,000 and exhibiting an ethylene-propylene weight ratio ranging from 60/40 to 54/46, from 2 to 8 parts by weight of at least one poly($C_1$–$C_{20}$ alkyl methacrylate), ungrafted or grafted with from 1 to 8% of its weight of a dispersant monomer, said polyalkyl methacrylate exhibiting a weight-average molecular mass ranging from approximately 30,000 to approximately 150,000, the ungrafted or grafted polyalkyl methacrylate/ethylene-propylene copolymer weight ratio ranging from 1/5 to 1/1, and the complement to 100 parts by weight of diluent oil.

2. The composition of claim 1, wherein said composition comprises:

7.5 to 12.5 parts by weight of said ethylene-propylene copolymer,
2.5 to 7.5 parts by weight of said polyalkyl methacrylate, and the complement to 100 parts by weight of said diluent oil.

3. The composition of claim 1, wherein said composition additionally comprises up to 10% of its weight of an antioxidant agent.

4. The composition of claim 2, wherein said composition additionally comprises up to 10% of its weight of an antioxidant agent.

5. The composition of claim 1, wherein said poly($C_1$–$C_{20}$ alkyl methacrylate) is ungrafted.

6. The composition of claim 1, wherein said poly($C_1$–$C_{20}$ 20 alkyl methacrylate) is grafted with from 1 to 8% of its weight of a dispersant monomer.

7. The composition of claim 6, wherein said dispersant monomer is a nitrogenous vinyl monomer.

8. The composition of claim 7, wherein said nitrogenous vinyl monomer is selected from N-vinylpyrrolidone, N-vinylimidazole and N-vinylpyridine.

9. The composition of claim 1, wherein said ethylene-propylene copolymer has a weight-average molecular mass of from 155,000 to 230,000.

10. The composition of claim 9, wherein said ethylene-propylene copolymer has a weight-average molecular mass of from 155,000 to 190,000.

11. The composition of claim 1, wherein said ungrafted or grafted polyalkyl methacrylate has a weight-average molecular mass of from 60,000 to 120,000.

12. The composition of claim 1, wherein said ethylene-propylene copolymer exhibits an ethylene/propylene weight ratio of from 58/42 to 54/46.

13. The composition of claim 1, wherein both said ethylene-propylene copolymer and said polyalkyl methacrylate have a polydispersity index which is lower than 3.5.

14. The composition of claim 1, wherein said polyalkyl methacrylate is a mixture of from 0 to 10% by weight of light polymethacrylates in which the alkyl group is lower than $C_4$ and of from 10 to 100% by weight of heavy polymethacrylates in which the alkyl group ranges from $C_{10}$ to $C_{20}$.

15. The composition of claim 14, wherein the alkyl group of said heavy polymethacrylates ranges from $C_{10}$ to $C_{18}$.

16. A lubricating composition comprising at least one lubricating oil and an additive composition comprising:

from 6 to 15 parts by weight of at least one ethylene-propylene copolymer of weight-average molecular mass ranging from approximately 155,000 to approximately 250,000 and exhibiting an ethylene-propylene weight ratio ranging from 60/40 to 54/46, from 2 to 8 parts by weight of at least one poly($C_1$–$C_{20}$ alkyl methacrylate), ungrafted or grafted with from 1 to 8% of its weight of a dispersant monomer, said polyalkyl methacrylate exhibiting a weight-average molecular mass ranging from approximately 30,000 approximately 150,000 the ungrafted or grafted polyalkyl methacrylate/ethylene-propylene copolymer weight ratio ranging from 1/5 to 1/1, and the complement to 100 parts by weight of diluent oil.

17. The lubricating composition of claim 16, wherein said additive composition is in an amount of from 0.1 to 10% by weight based on the weight of said lubricating oil.

18. A viscosity additive comprising:

from 6 to 15 parts by weight of at least one ethylene-propylene copolymer of weight-average molecular mass ranging from approximately 155,000 to approximately 250,000 and exhibiting an ethylene-propylene weight ratio ranging from 60/40 to 54/46, from 2 to 8 parts by weight of at least one poly($C_1$–$C_{20}$ alkyl methacrylate), ungrafted or grafted with from 1 to 8% of its weight of a dispersant monomer, said polyalkyl methacrylate exhibiting a weight-average molecular mass ranging from approximately 30,000 to approximately 150,000 , the ungrafted or grafted polyalkyl methacrylate/ethylene-propylene copolymer weight ratio ranging from 1/5 to 1/1, and the complement to 100 parts by weight of diluent oil.

19. A method of using the viscosity additive of claim 18 comprising the step of adding the viscosity additive to a lubricating oil.

* * * * *

UNITED STATES PATENT AND TRADEMARK OFFICE

CERTIFICATE OF CORRECTION

PATENT NO. : 5,108,635

DATED : April 28, 1992

INVENTOR(S) : Philippe Gabillet et al.

It is certified that error appears in the above-identified patent and that said Letters Patent is hereby corrected as shown below:

Claim 1, column 6, line 46, change "comprising" to --comprising:--.

Claim 6, column 7, line 14, before "alkyl" Delete "20".

Claim 16, column 8, line 17, after "30,000" insert --to-- and after "150,000" insert --,--.

Signed and Sealed this

Twenty-eighth Day of September, 1993

Bruce Lehman

*Attest:*

BRUCE LEHMAN

*Attesting Officer*

*Commissioner of Patents and Trademarks*